US005575683A

United States Patent [19]

Saito et al.

[11] Patent Number: 5,575,683

[45] Date of Patent: Nov. 19, 1996

[54] CONNECTOR WITH FRONT PIECE FIXING TERMINALS

[75] Inventors: Hitoshi Saito; Hideki Ohsumi; Yoshinori Tomita, all of Shizuoka, Japan

[73] Assignee: Yazaki Corporation, Tokyo, Japan

[21] Appl. No.: 280,325

[22] Filed: Jul. 25, 1994

[30] Foreign Application Priority Data

Aug. 6, 1993 [JP] Japan ..... 5-196182
Jun. 24, 1994 [JP] Japan ..... 6-143121

[51] Int. Cl.[6] ..... H01R 13/40
[52] U.S. Cl. ..... 439/595
[58] Field of Search ..... 439/595

[56] References Cited

U.S. PATENT DOCUMENTS

| | | | |
|---|---|---|---|
| 4,784,617 | 11/1988 | Oda | 439/595 |
| 5,085,559 | 2/1992 | Maejima et al. | 439/595 |
| 5,108,309 | 4/1992 | Oda et al. | 439/595 |
| 5,322,457 | 6/1994 | Tsuji et al. | 439/595 |
| 5,397,249 | 3/1995 | Endo et al. | 439/595 |

FOREIGN PATENT DOCUMENTS

| | | |
|---|---|---|
| 1-213973 | 3/1989 | Japan . |
| 3-285280 | 12/1991 | Japan . |

*Primary Examiner*—Neil Arrams
*Assistant Examiner*—Barry Matthew L. Standig
*Attorney, Agent, or Firm*—Nikaido, Marmelstein, Murray & Oram LLP

[57] ABSTRACT

An electrical connector in which a front piece fixing terminals in the preliminarily locked stage does not unintentionally move to the fully locked stage. In the electrical connector, the front piece fixing terminals C slidably attached, in the axial direction of the connector, to a connector housing A at the fore portion thereof; in the preliminarily locked stage of the front piece fixing terminals with the connector housing A, the front piece C allows a resilient plate 7 on a terminal accommodation slot to deflect to cause a terminal B to be inserted into a terminal accommodation slot 1; in the fully locked stage of the front piece C with the connector housing A, the front piece C prevents the resilient plate 7 from deflecting to maintain the terminal B in the terminal accommodation slot 1, wherein an operating portion 24 attached to a free end of the front piece C is provided with a main locking resilient arm extending in the opposite direction to the connector housing A and a main locking projection 25 is formed on a main locking resilient arm 24.

3 Claims, 11 Drawing Sheets

CONNECTOR WITH FRONT PIECE FIXING TERMINALS

BACKGROUND OF THE INVENTION

1. Field of the Invention

This invention relates to a connector, and more particularly to a connector with a front piece fixing terminals for connecting wiring harnesses or the like in automobiles.

2. Description of the Prior Art

Referring to FIG. 12, in an enclosing wall a1 of a connector housing a, a plurality of cylindrical members c with terminal accommodation slots b run side by side and a part of an upper wall c1 of the cylindrical member c is cut to form a resilient locking arm d of a cantilever type. A locking projection d1 disposed towards the terminal accommodation slots is formed on a free end of the resilient locking arm d.

Reference symbol e is a box-shaped front piece for fixing terminals which engage with the fore ends of the plurality of cylindrical members c in such a manner as to enclose the fore ends together. The front piece e is provided with a preliminary locking projection f formed at an end of a side wall e1 and main locking projections h formed on a resilient plate g of an upper wall e2.

The front piece e is engaged at the preliminary locking projection f thereof with a fore end of a long hole i of the side wall c2 of the cylindrical member c, and is further engaged at the main locking projection h with the fore end of the upper wall c1 in a preliminarily locked stage in advance. Under this condition, terminals j are inserted into the terminal accommodation slots b from the rear portion of the cylindrical member c, and the terminal j causes the resilient locking arm d to bend outwardly, and then, the resilient locking arm d returns to its original position to allow the locking projection d1 thereof to be received in the locking portion j1, which completes the first locking of the terminal j as illustrated in FIGS. 14 and 16.

Then, the front piece e is further pushed to allow the main locking projection h to ride on the upper wall for crossing over thereof c1 and to be engaged with a cut opening c1' surrounding the resilient locking arm d, causing the terminal to be fully locked. In this stage, the upper wall e2 of the front piece e is positioned on the resilient locking arm d to prevent the deflection of the resilient locking arm d, resulting in the secondary locking of the terminal j as illustrated in FIGS. 17 and 15.

SUMMARY OF THE INVENTION

With the construction of the conventional connector described above, one drawback exists for instance in that the front piece fixing terminals in the preliminarily locked stage is susceptible to transit to the fully locked stage due to external force when transporting the connector. When the engagement is strengthened by adjusting the shape of the projection thereof to avoid the above drawback, considerably large force is required to transit to the fully locked stage, and further, it is difficult to turn back to the preliminary locked stage for the maintenance, such as the detachment of the terminals.

The present invention has been accomplished to eliminate the above drawbacks in the conventional connectors, and the object thereof is to provide a connector in which the front piece for fixing the terminals is securely supported in the preliminarily locked stage and the transition to the fully locked stage is easily carried out.

Further, in the present invention, when unlocking the front piece fixing terminals, a supporting portion of a resilient arm in operation is changed to increase the load applied to the resilient arm so that the front piece fixing terminals is locked stably, and further, corresponding to the transition of the front piece from the preliminarily locked stage to the fully locked stage, the transition thereof from fully locked stage to the preliminarily locked stage can be performed easily.

To accomplish the above object, in the connector according to the present invention, the front piece fixing terminals is attached to a connector housing at the fore portion thereof, slidably in the axial direction; in the preliminarily locked stage of the front piece fixing terminals with the connector housing, the front piece allows a resilient plate on a terminal accommodation slot to deflect for causing a terminal to be inserted into the terminal accommodation slot; in the fully locked stage the front piece with the connector housing, the front piece prevents the resilient plate from deflecting to maintain the terminal in the terminal accommodation slot; wherein characterized in that a main locking resilient arm is provided in the front piece, an operating portion being attached to the free end of the main locking resilient arm and being extended in the opposite direction to the connector housing, and a main locking projection is formed on the main locking resilient arm.

The present invention is further characterized in that a support projection jutting toward the main locking resilient arm is formed on a fixed wall opposite to the main locking resilient arm; when unlocking the main locking resilient arm, the supporting point shifts from a first supporting point on a base portion of the main locking resilient arm to a second supporting point on the support projection; a relief channel is formed on the main locking resilient arm to receive the support projection and the relief channel is situated at the position where the relief channel does not receive the support projection in the preliminarily locked stage, and the support projection is received by the channel in the fully locked stage of the front piece fixing terminals.

In the operation thereof, by the operating portion, the main locking resilient arm is deviated in opposition to its resilience so that the engagement between the main locking projection and the corresponding locking portion is dissolved. Further, in this operation of the main locking resilient arm, the load thereof is changed according to the transfer of the supporting point.

BRIEF DESCRIPTION OF THE DRAWINGS

The present invention will be more understandable from the ensuring description with reference to the accompanying drawings thereof.

DETAILED DESCRIPTION OF PREFERRED EMBODIMENTS

Figure 1:
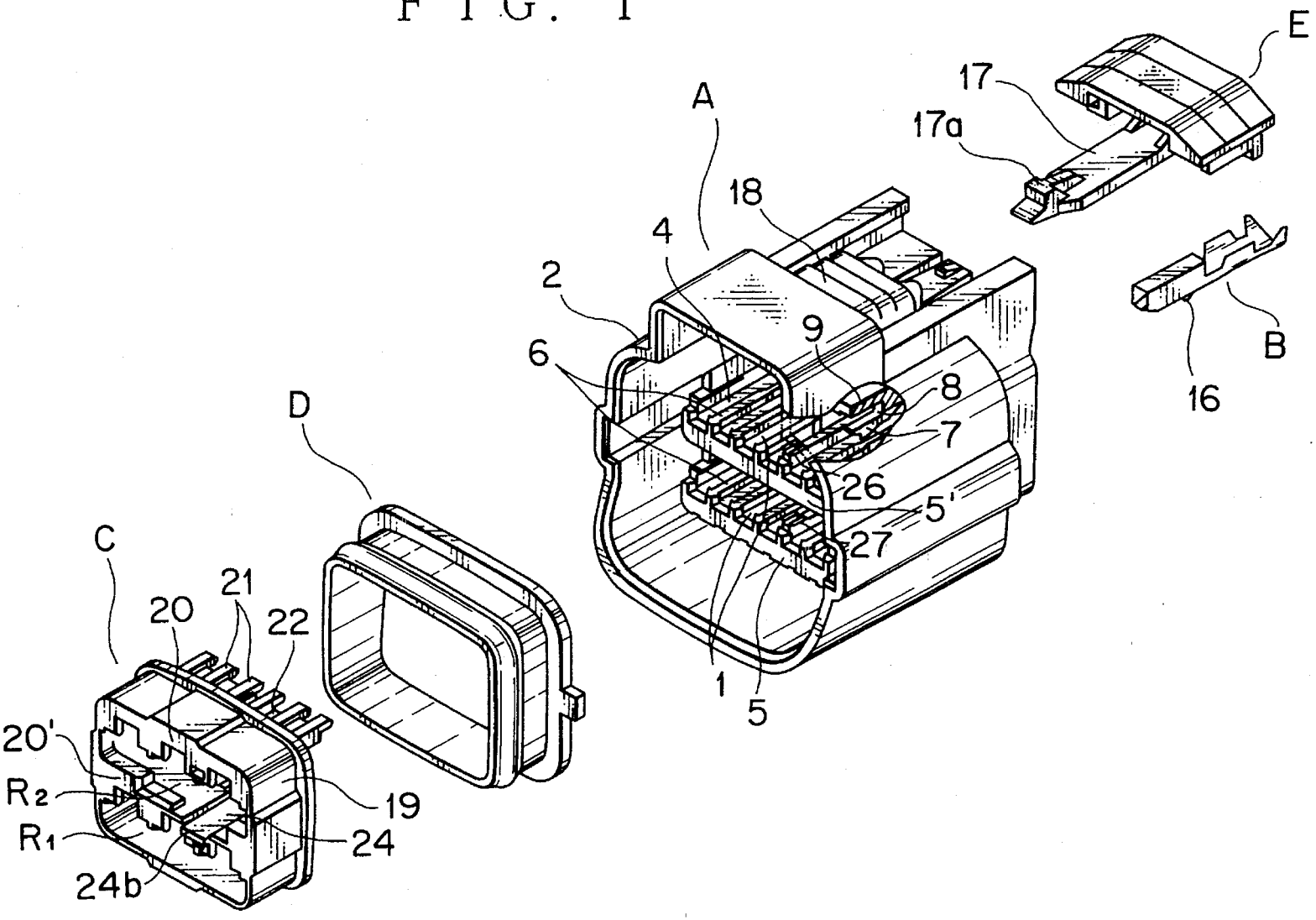
FIG. 1 is an exploded perspective view of a connector according to the present invention.

In FIG. 1, a connector housing A, a female terminal B, a front piece fixing terminals C, a rectangular watertight packing D, and a lock confirmation slider E are shown. In the connector housing, two-stories six terminal accommodation slots 1 are provided in an enclosing wall 2. Each terminal accommodation slot 1 is cut at the front portion of an upper wall 3 thereof to form an opening 4 so that the terminal accommodation slots 1 are integrally formed with each other on a set of bottom walls 5 and 5' between side walls 6.

Resilient locking plates 7 are formed on ends of the upper walls 3 of the terminal accommodation slots 1 of cantilever type directing the terminal accommodation slots, and a set of fixed wall portions 9 and 9' are provided over the locking plates 7. Between the resilient locking plates 7 and the fixed wall portions 9 and 9', the spaces 8 to allow the resilient locking plates 7 to deflect are situated. The upper wall 9 and the lower bottom wall 5 are integrally formed with each other to form a ring, and a watertight packing D is attached to the outer peripheral portion of the ring. In each terminal accommodation slot 1, the bottom walls 5 and 5' are provided with a guide slit 10 and a guide channel 10' extending in the axial direction of the connector housing A.

Figure 3:
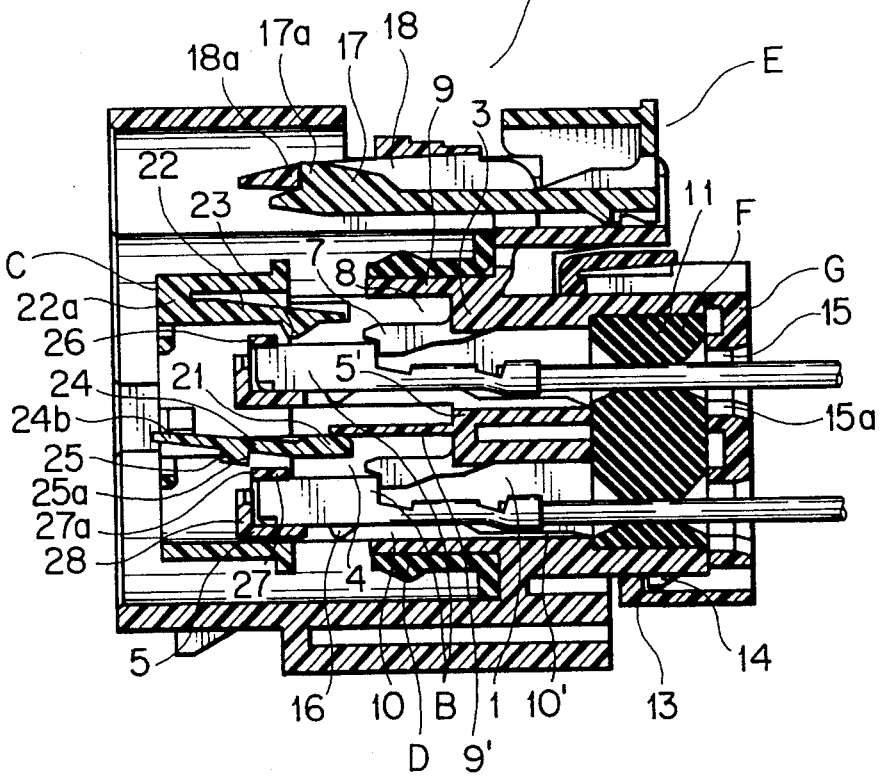
FIG. 3 is a cross-sectional view of the connector shown in FIG. 2 to which terminals are inserted.
Figure 4:
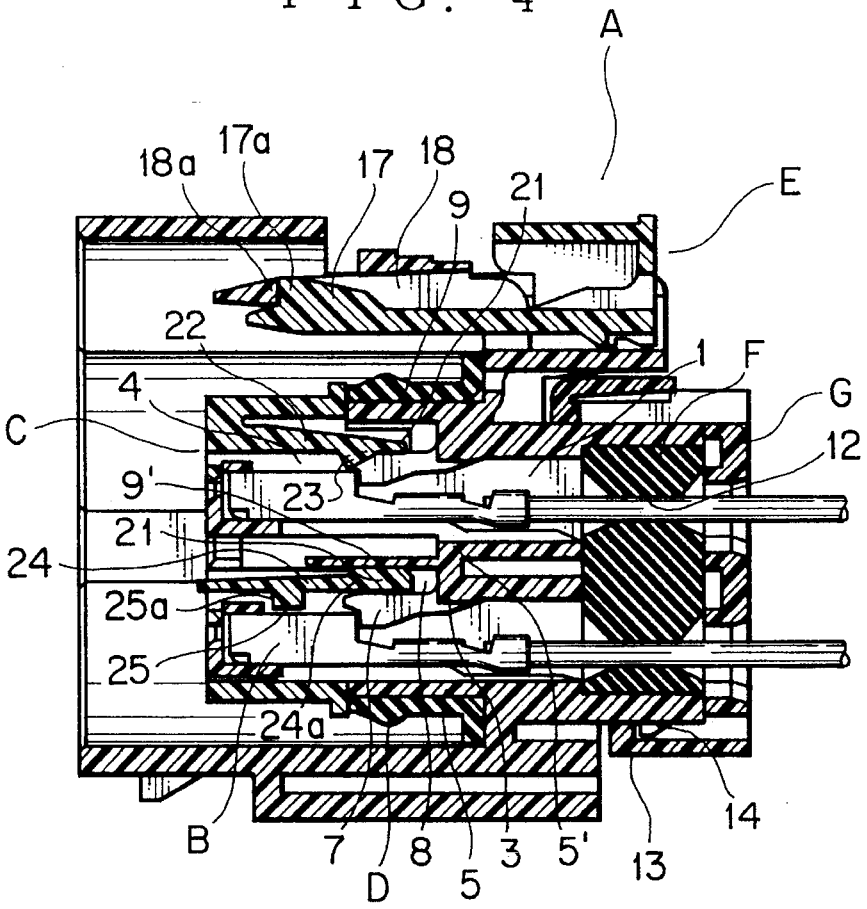
FIG. 4 is a cross-sectional view of the connector according to the present invention in which the front piece fixing terminals is fully locked to the connector housing.
Figure 5:
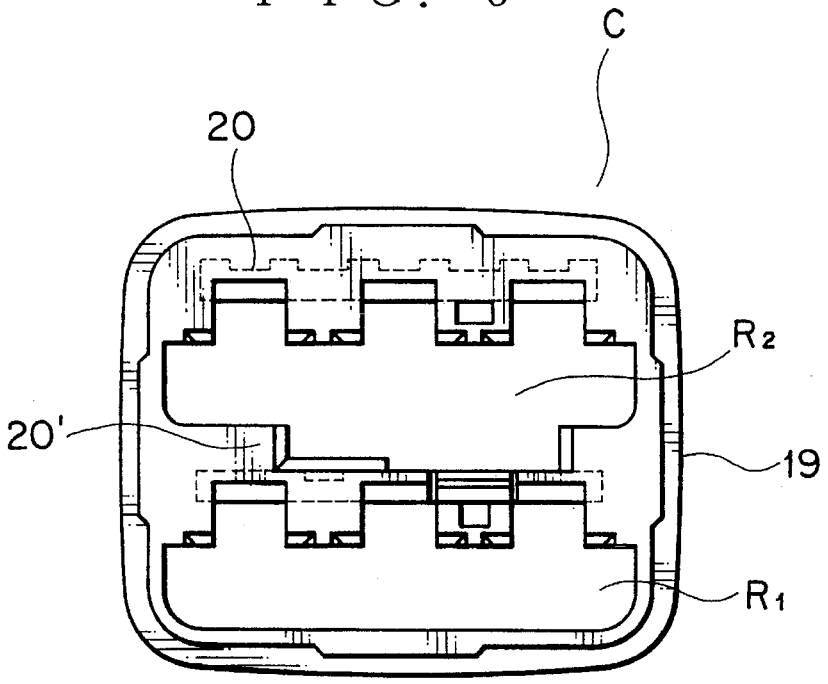
FIG. 5 is a front view of the front piece fixing terminals according to the present invention.

At a rear portion of the connector housing A engagement chamber 11 for a watertight packing F is formed, and round insertion holes 12 for sealing terminals which are to be accommodated in the terminal accommodation slots 1 are formed in the watertight packing F made of resilient material such as rubber which is to be accommodated in the chamber. 11. Further, a cover G for fixing the watertight packing F is positioned at an rear portion of the connector housing A to prevent the watertight packing F from being slipped off by engaging and fixing a resilient arm 13 with a locking projection 14 on a peripheral wall of the connector housing A. The watertight packing cover G is provided with a rectangular insertion hole 15 in combination with the insertion holes 12 of the watertight packing F. Further, a concave portion **15*a* is formed in the insertion hole 15 on the side of the guide slit 10 and the guide channel 10' to restrict the posture of the terminal B when inserted, and a convex portion 16 is formed on the bottom face of the female terminal B for the same purpose as illustrated in FIG. 3**.

A lock confirmation slider E is provided with a lock detection arm 17. A stopper **17*a* on a free end of the lock detection arm 17 engages with a locking portion 18*a* at a free end of the locking arm 18. When the connector housing A is completely engaged with the mated connector housing and the locking portion 18*a* of the locking arm 18 is engaged with the mated locking portion not shown in the drawings, the lock detection arm 17 is released from the restriction of the locking arm 18** to allow the lock confirmation slider E to proceed, permitting the full locking of the connector to be confirmed as disclosed in Japanese Patent Preliminary Publication No. Heisei 3-285280.

The front piece C for fixing terminals is provided with a cylindrical peripheral wall 19, and supporting plate portions 20 and 20' are formed at the upper portion and intermediate portion of the peripheral wall 19. Horizontally arranged restriction pieces 21 are integrally formed with the supporting plate portions 20 and 20' in accordance with the spaces 8 for the resilient locking plates 7. Further, openings R1 and R2 which are divided by the supporting plate portion 20' in the middle of the front piece C extend in the axial direction of the connector housing A, and terminal accommodation slots at the corresponding bottom walls 5 and 5' may pass through the openings R1 and R2 respectively. As a result, the front piece C is capable of sliding in the connector housing A in the axial direction thereof.

Figure 6:
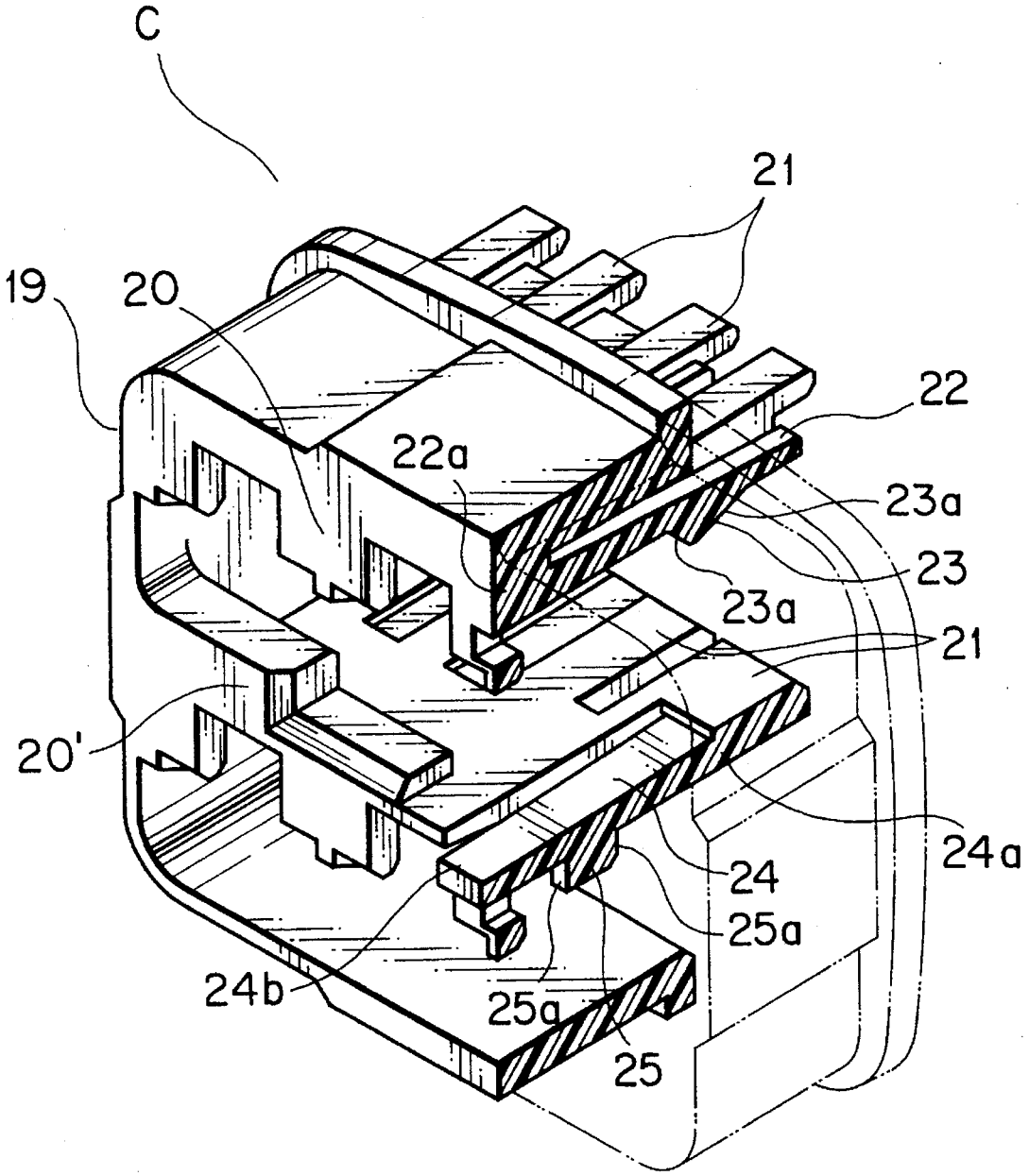
FIG. 6 is a partially fragmented perspective view of the front piece fixing terminals observed diagonally in front of the front piece.
Figure 7:
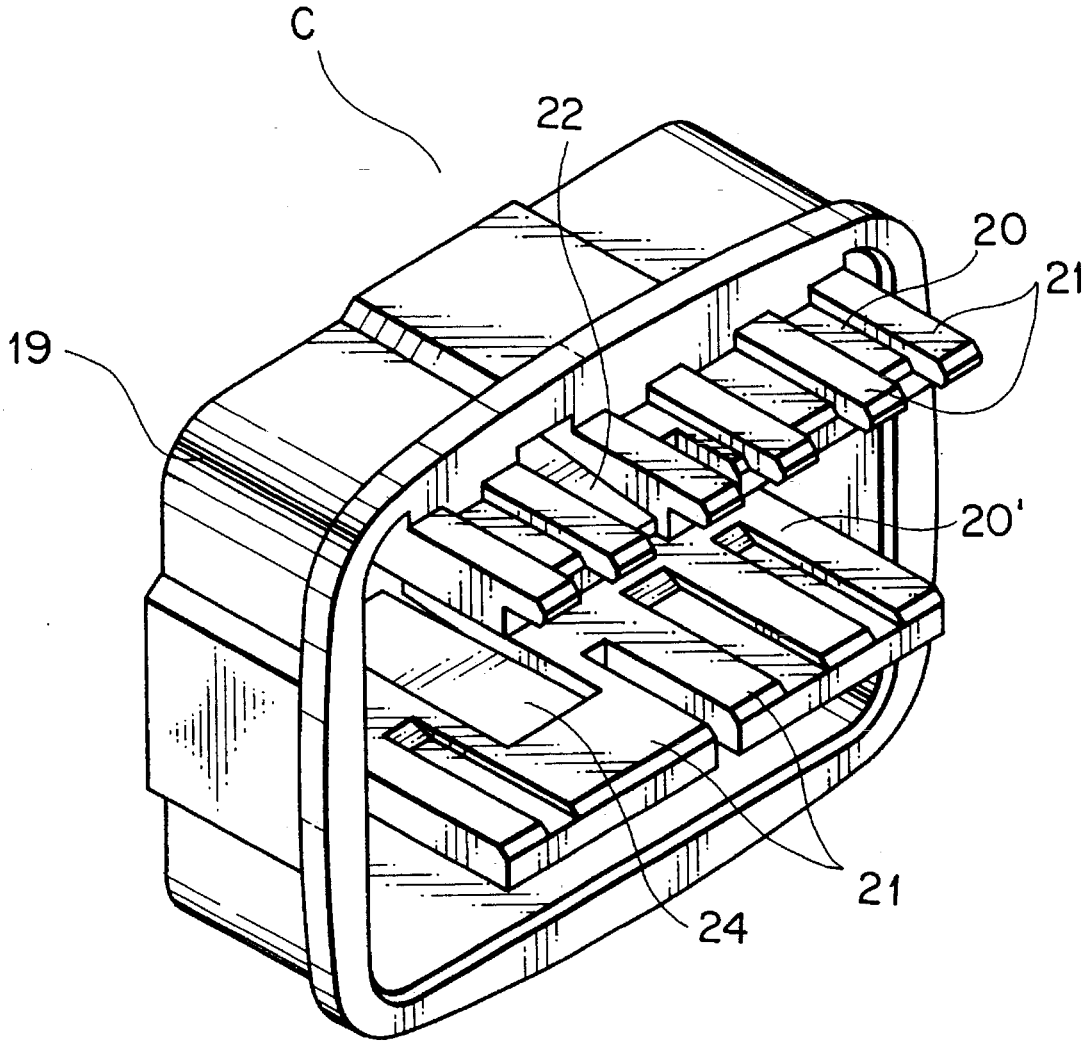
FIG. 7 is a perspective view of the front piece fixing terminals observed diagonally in the rear of the front piece.

The supporting plate portion 20 at the upper portion of the front piece C is provided with preliminary locking resilient arms 22 of which free ends extend from base portions **22*a* to the connector housing A side. The preliminary locking resilient arm 22 is provided with a preliminary locking projection 23 with tapered engagement faces 23*a* in the traveling direction of the front piece C as indicated in FIG. 6**.

A main locking resilient arm 24 of which free end outwardly extends from a base portion **24*a* on the side of the connector housing A is attached to the supporting plate portion 20' in the middle of the front piece C. In the middle of the main locking resilient arm 24 is formed a main locking projection 25 with vertical engagement faces 25*a* in the traveling direction of the front piece. An operating portion 24*b* is formed at a free end of the front piece C as illustrated in FIG. 6**.

A preliminary locking portion 26 and a main locking portion 27 are formed on the side wall 6 dividing the terminal accommodation slots 1 of the connector housing A.

Figure 2:
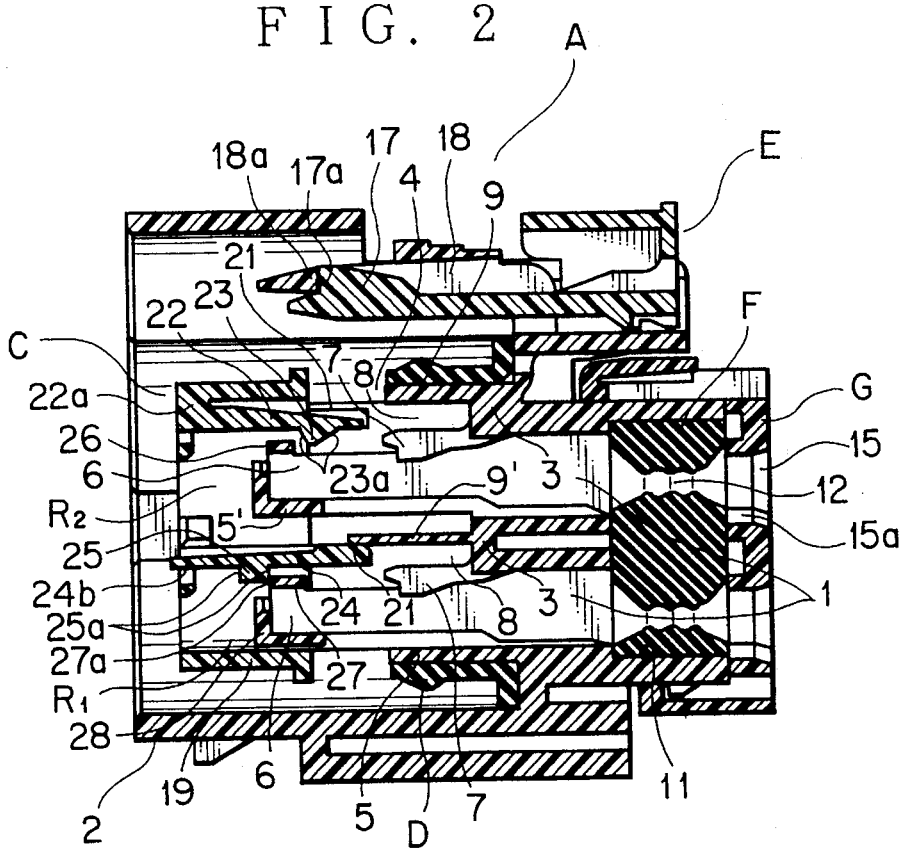
FIG. 2 is a cross-sectional view of the connector according to the present invention in which a front piece fixing terminals is preliminarily locked to a connector housing.

FIG. 2 shows the stage in which the front piece C is preliminarily locked to the connector housing A. The tapered locking face **23*a* of the preliminary looking projection 23 on the preliminary locking resilient arm 22 is engaged with the preliminary locking portion 26 at the inside thereof, and the vertical locking face 25***a* of the main locking projection 25 on the main locking resilient arm 24 abuts the main locking portion 27 at the outside thereof. As a result, the front piece C will not move toward the connector housing A due to an unintentional external force.

In the preliminarily locked stage of the front piece C, the terminal B is inserted from the rear portion of the connector housing A into the terminal accommodation slot while the resilient locking plate 7 deflects in the space 8, and then the front end of the terminal B abuts the stopper 28 and the resilient locking plate 7 returns to its original position to lock the terminal B.

At the insertion of the terminal B, the terminal B passes through the openings 15 while the convex portion for restricting the posture of the terminal B is engaged with the concave portion 15*a* for restricting the posture of the terminal B on watertight packing cover G, so that the terminal B is inserted into the terminal accommodation slot 1 in he correct posture. Then, the convex portion 16 moves from the guide channel 10' to the guide slit 10 and is engaged with it to stabilize the posture of the terminal B in the terminal accommodation slots 1 as illustrated in FIG. 3. After the terminal is inserted, the operating portion 24*b* causes the main locking resilient arm 24 to be driven upward in opposition to its resilience so that the engagement between the main locking projection 25 and the main locking portion 27 is dissolved as shown in FIG. 3.

These conditions, the front piece C is pushed in and the main locking projection 25 is engaged with the vertical engagement face 27*a* on the inner side of the main locking portion 25 to maintain the fully locked stage of the front piece C. At that moment, the restriction piece 21 proceeds into the space 8 opposite thereto, which maintains looking of the terminal B by preventing the resilient plate 7 or the terminal B from deflecting, as illustrated in FIG.

In the construction illustrated in FIGS. 8 to 11, a support projection 29 jutting toward the main locking resilient arm 24' is formed on the bottom wall 5' as a fixed wall opposing the main locking resilient arm 24' of the front piece fixing terminals C to the connector housing A'. A relief channel 24*c* is formed on the support projection 29 side of the main locking resilient arm 24' from a portion adjacent to the main locking projection 25 to a free end thereof.

Figure 8:
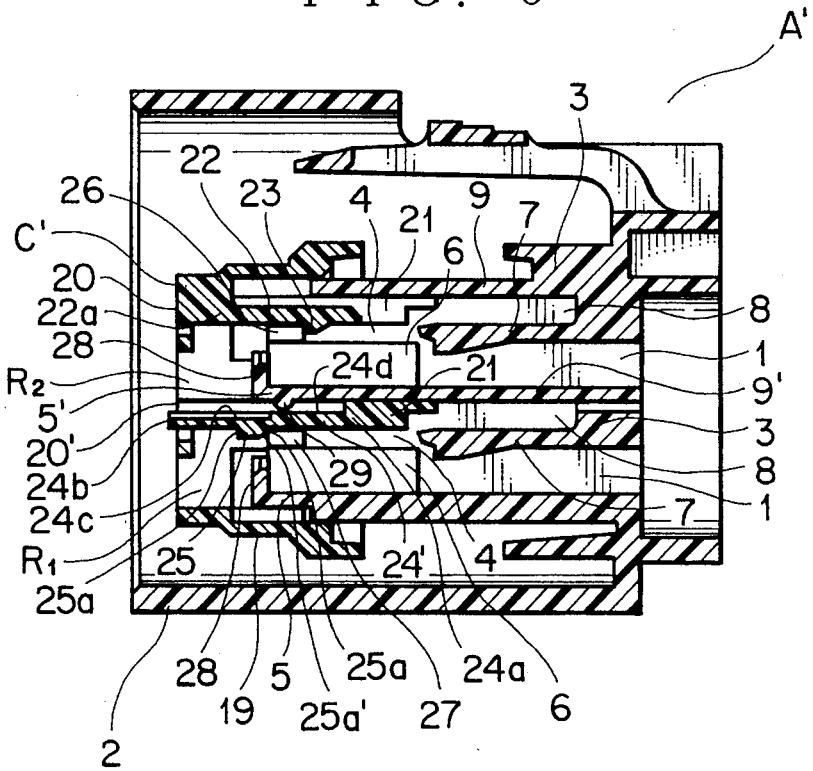
FIG. 8 is a cross-sectional view of a connector according to another embodiment of the present invention in which a front piece fixing terminals is preliminarily locked to a connector housing.

In the preliminarily locked stage of the front piece C, the support projection 29 opposes a portion 24*d* without channel between the support base portion 24*a* on the main locking resilient arm 24' and the main locking projection 25 as illustrated in FIG. 8. Under these conditions, when the external force is unintentionally applied to the main locking resilient arm 24' to move the front piece C' to the fully locked stage, the main locking resilient arm 24' abuts the support projection 29 to prevent the arm 24' from ascending, and the tapered engagement face 25*a'*adjacent to the vertical face 25*a* at the front portion of the main locking projection 25 abuts the main locking portion 27 of the connector housing A' to prevent the transition of the front piece C' as illustrated in FIG. 9.

Figure 9:
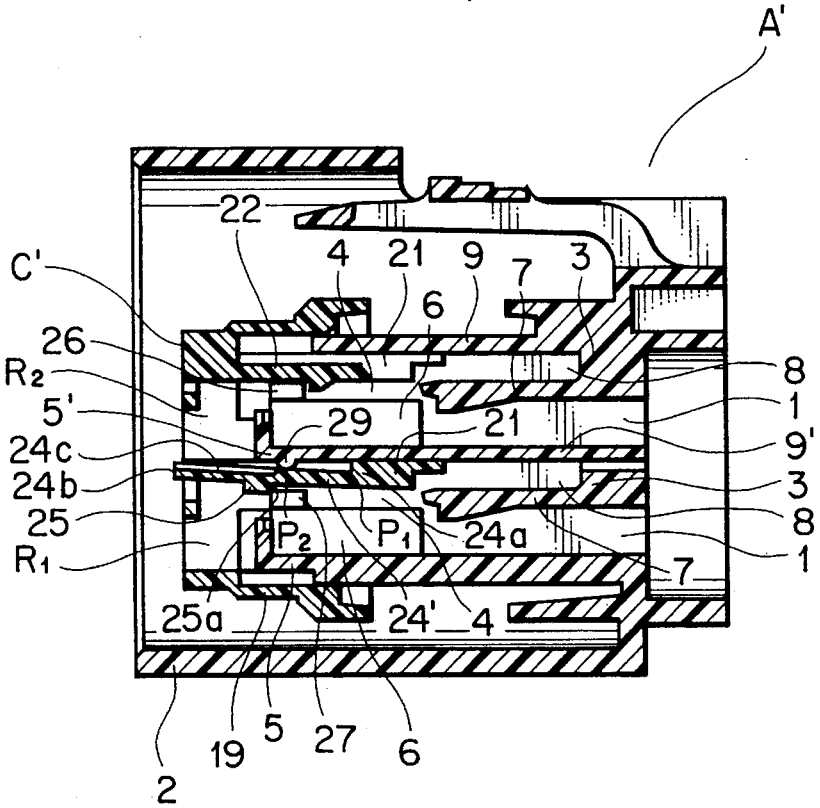
FIG. 9 is a cross-sectional view showing the operating condition of a main locking resilient arm in FIG. 8.
Figure 10A:
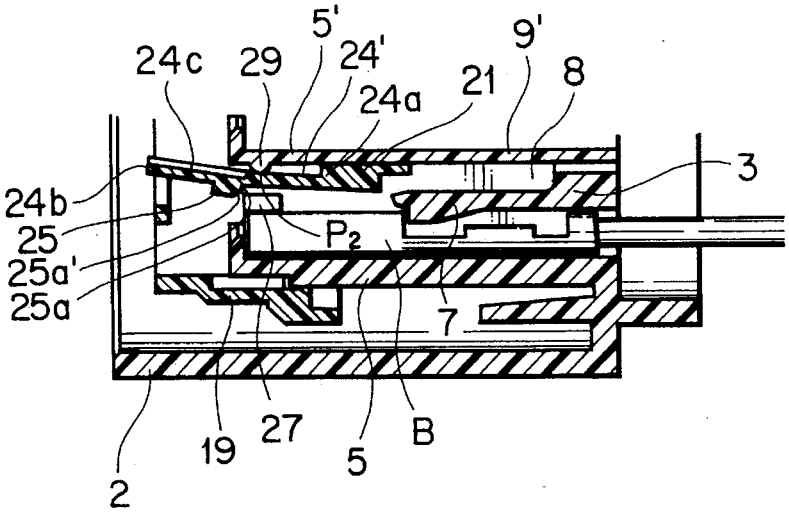
FIGS. 10(A), 10(B), and 10(C) are cross-sectional views showing the process for moving the front piece fixing terminals from the preliminarily locked stage to the fully locked stage by operating the main locking resilient arm.
Figure 10B:
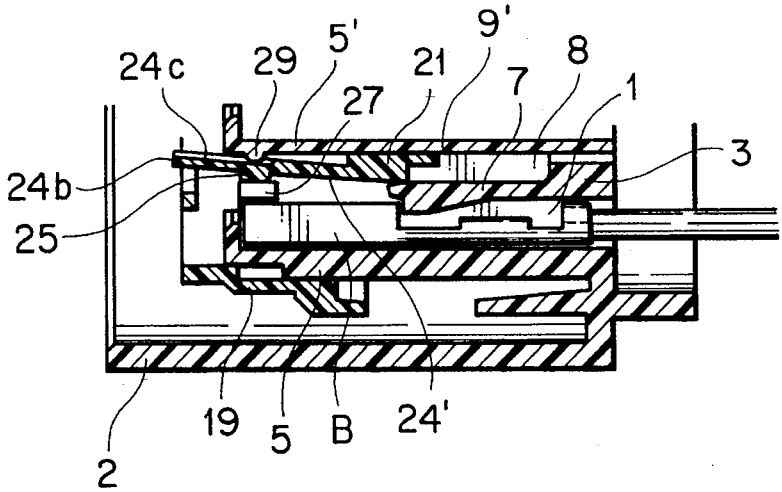
Figure 10C:
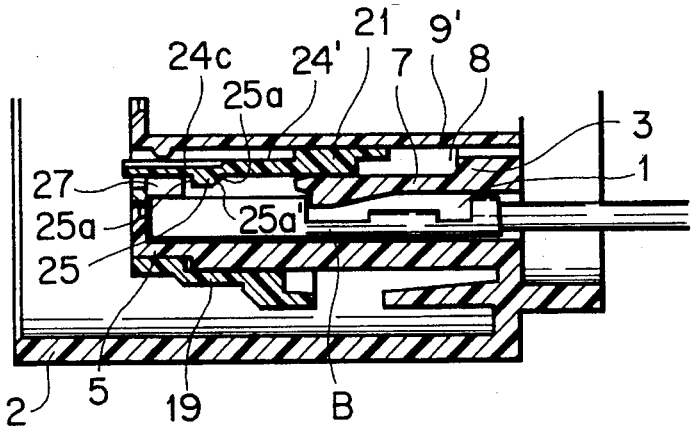

In order to move the front piece C' to the fully locked stage, the main locking resilient arm 24' is further bent under the condition as indicated in FIG. 9 by the operating portion 24*b* to disengage the main locking projection 25 from the main locking portion 27 as indicated in FIG. 10(A), and the front piece C' is moved under the condition as shown in FIG. 10(8), and after the main locking projection 25 rides crossing over the main locking portion 27, the main locking resilient arm 24' returns to its original position to obtain the fully locked stage as illustrated in FIG. 10(C). In the main locking resilient arm 24' described in FIG. 10(A), the working point thereof moves from a first support P1 on the support base portion 24*a* to a second point P2 on the support projection 29, so that load applied to the main locking resilient arm 24' at the transition to the fully locked stage is increased to prevent unintentional transition to the fully locked stage of the front piece C'. However, the increase of the load occurs only at the initial step of the operation, and in the intermediate stage of the transition, the support projection 29 enters the relief channel 24*c* to reduce the load as illustrated in FIG. 10(B).

Figure 11A:
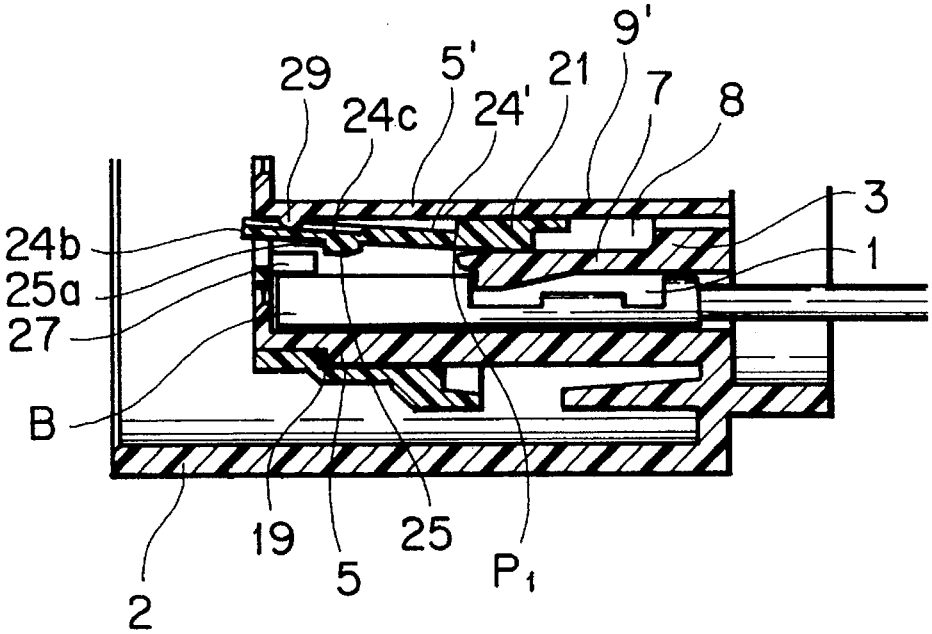
FIGS. 11(A) and 11(B) are cross-sectional views indicating the process for moving the front piece fixing terminals from the fully locked stage to the preliminarily locked stage by operating the main locking resilient arm.
Figure 11B:
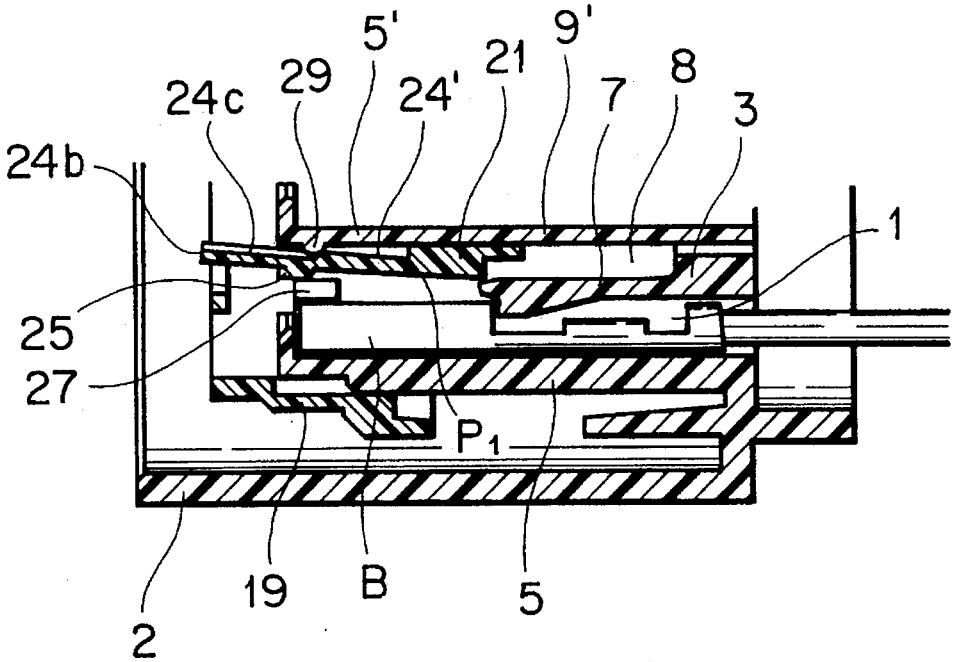
Figure 12:
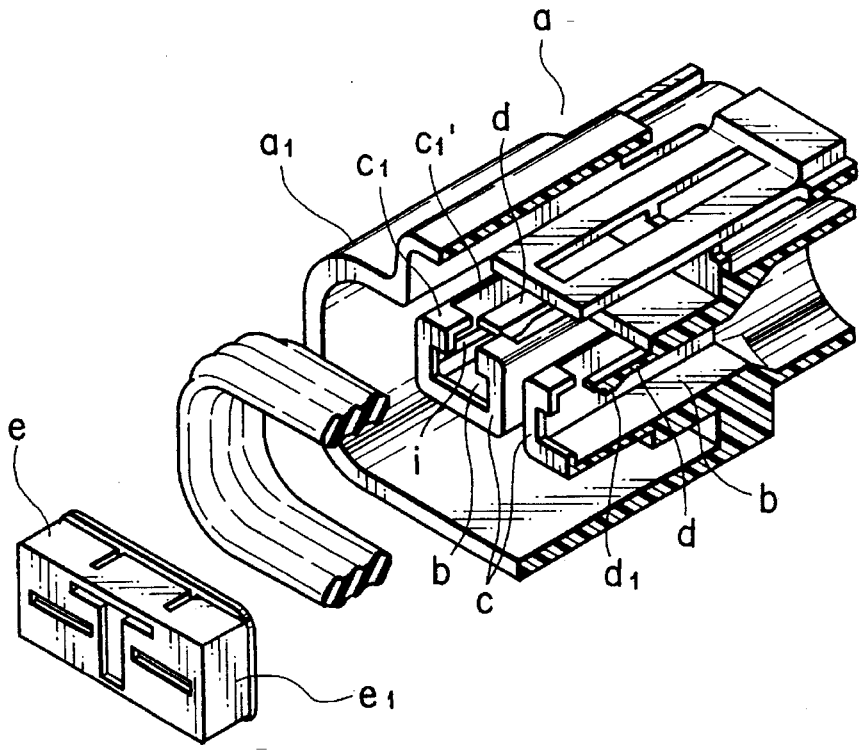
FIG. 12 PRIOR ART
FIG. 12 is an exploded perspective view of a conventional electrical connector.
Figure 13:
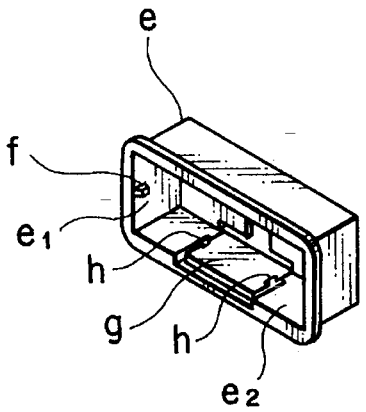
FIG. 13 PRIOR ART
FIG. 13 is a perspective view of a front piece fixing terminals of the electrical connector in FIG. 12.
Figure 14:
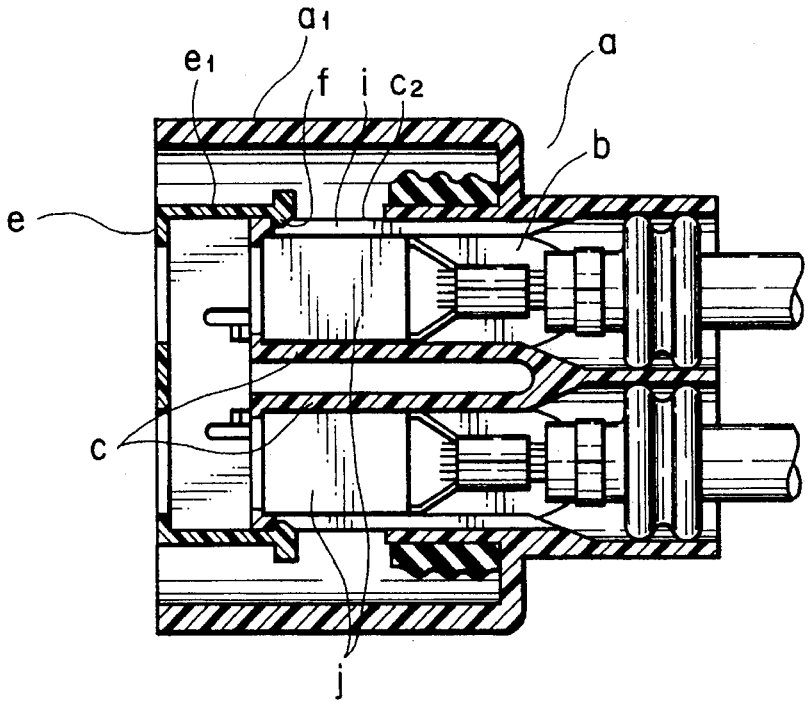
FIG. 14 PRIOR ART
FIG. 14 is an overhead cross-sectional view of the front piece fixing terminals and a connector housing in which the fixing member is preliminarily locked to the connector housing illustrated in FIG. 13.
Figure 15:
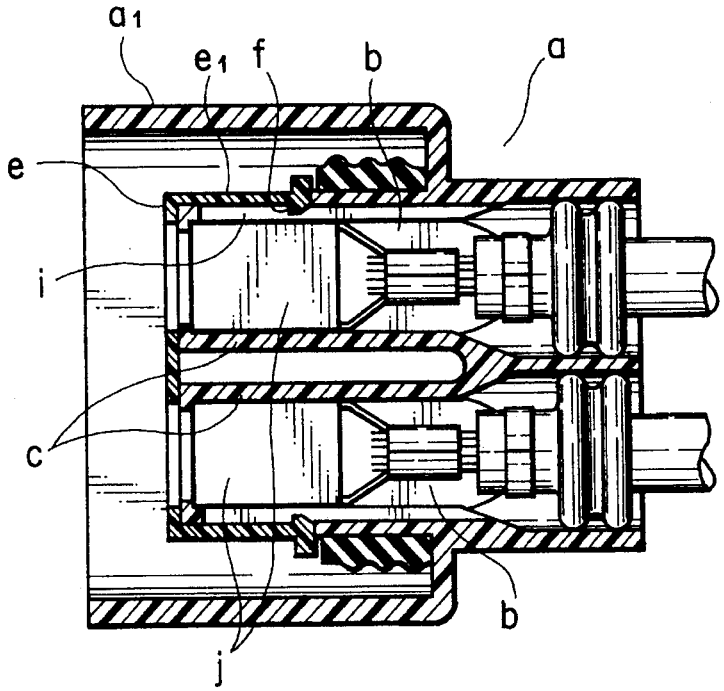
FIG. 15 PRIOR ART
FIG. 15 is an overhead cross-sectional view of the fixing member and the connector housing in fully locked stage of the connector in FIG. 12.
Figure 16:
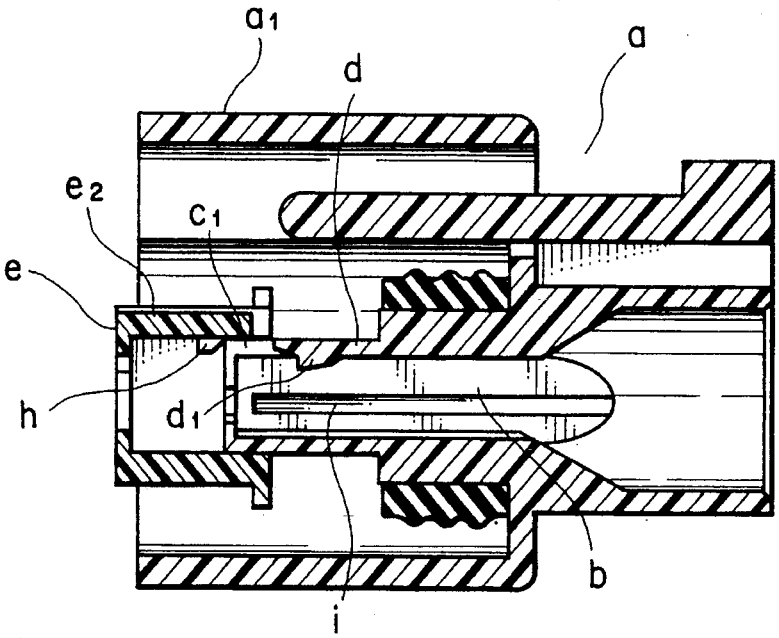
FIG. 16 PRIOR ART
FIG. 16 is a lateral cross-sectional view of the fixing member and the connector housing in preliminarily locked stage of the connector in FIG. 12.
Figure 17:
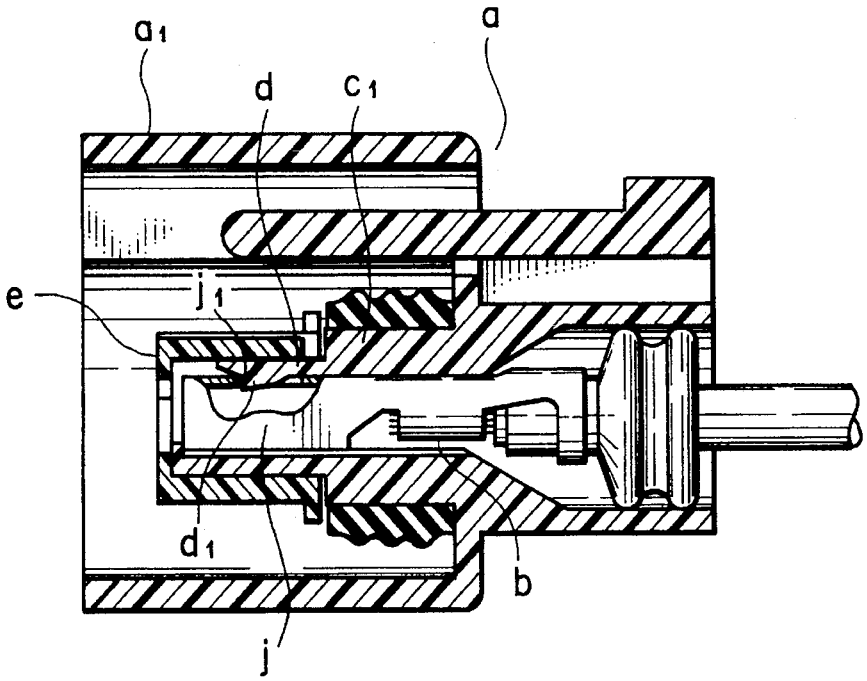
FIG. 17 PRIOR ART
FIG. 17 is a lateral cross-sectional view of the fixing member and the connector housing in fully locked stage of the connector in FIG. 12.

When the front piece C' returns to the preliminarily locked stage from the fully locked stage, the main locking resilient arm 24' moves around the first support P1 since the relief channel 24*c* thereof receives the support projection 29 so as to be easily operated with small force as indicated in FIGS. 11(A) and 11(B).

With the connector with a front piece fixing terminals according to the present invention, the deflection of the main locking resilient arm caused by the operating portion facilitates the easy disengagement of the main locking projection from the main locking portion while the engagement between the main locking portion and the main locking projection opposing thereto is strengthened as much as possible. As a result, the front piece fixing terminals positioned in the preliminarily locked stage is prevented from unintentionally moving to the fully locked stage with certainty.

In addition, in the present invention, the supporting point of the resilient arm under operation can be changed to increase the load when unlocking the front piece fixing terminals, which causes the front piece to be locked stably and further, corresponding to the transition of the front piece from the preliminarily locked stage to the fully locked stage, the transition thereof from fully locked stage to the preliminarily locked stage can be performed easily.

What is claimed is:

1. A connector comprising:

a front piece for fixing terminals to be slidably attached in an axial direction to a connector housing at a fore portion of said front piece;

in a preliminarily locked stage of said front piece with said connector housing, a deflectable resilient plate on a terminal accommodation slot, for causing a terminal to be inserted into a terminal accommodation slot, wherein said resilient plate and terminal accommodation slot are disposed in said connector housing;

in a locked stage of said front piece with said connector housing, said resilient plate is disposed so as to prevent from deflecting to maintain at least one of said terminals in at least one of said terminal accommodation slot; and wherein a main locking resilient arm is provided in said front piece, an operating portion extending from a free end of said main locking resilient arm to an outside of said front piece in an opposite direction to said connector housing, and a main locking projection is formed on said main locking resilient arm the main locking projection has a vertical locking face being able to abut a vertical engagement face provided in said connector housing in the preliminary stage said operating free end portion being capable of deflecting said main arm such that said main locking projection is releasable from said connector housing in said preliminary locked stage and in said locked stage.

2. A connector according to claim 1, wherein a support projection, is disposed so as to project toward said main locking resilient arm and is formed on a fixed wall opposite to said main locking resilient arm, and wherein said main locking resilient arm is disposed such that a supporting point shifts from a first supporting point on a base portion of said main locking resilient arm to a second supporting point on said support projection.

3. A connector according to claim 2, wherein a relief channel is formed on said main locking resilient arm to receive a support projection and said relief channel is situated where said relief channel does not receive said support projection in the preliminarily locked stage, and said support projection is received by said channel in the fully locked stage of said front piece.

* * * * *